United States Patent [19]

Cegielski, Jr.

[11] Patent Number: 4,476,791

[45] Date of Patent: Oct. 16, 1984

[54] HAZARDOUS WASTE STEAM GENERATOR

[75] Inventor: John M. Cegielski, Jr., Tulsa, Okla.

[73] Assignee: John Zink Company, Tulsa, Okla.

[21] Appl. No.: 498,006

[22] Filed: May 25, 1983

[51] Int. Cl.³ ..... F23G 7/00

[52] U.S. Cl. ..... 110/346; 110/237; 110/238; 423/481

[58] Field of Search ..... 110/346, 237, 238; 423/481; 122/4 R

[56] References Cited

U.S. PATENT DOCUMENTS

| | | | |
|---|---|---|---|
| 4,230,053 | 10/1980 | Deardorff et al. | 110/237 X |
| 4,244,325 | 1/1981 | Hart et al. | 122/4 R |
| 4,398,475 | 8/1983 | McKiel | 110/237 X |
| 4,402,274 | 9/1983 | Meenan et al. | 110/238 X |

*Primary Examiner*—Edward G. Favors

*Attorney, Agent, or Firm*—Head, Johnson & Stevenson

[57] ABSTRACT

A method and apparatus of converting hazardous waste fluids into non-hazardous effluent gases within a boiler environment.

5 Claims, 3 Drawing Figures

HAZARDOUS WASTE STEAM GENERATOR

BACKGROUND OF THE INVENTION

Government regulations have established requirements for the destruction of hazardous waste fluids. For example, the Resource Conservation and Recovery Act of the United States requires that in the burning of principle organic hazardous constituents (POHC's) a destruction and removal efficiency (DR&E) of at least 99.99% must be achieved for all POHC's except polychlorinated biphenols (commonly referred to as PCB's). PCB's are required to have a DR&E of at least 99.9999%. Heretofore, no one has been able to achieve destruction of POHC's and especially PCB's in the temperature, time, turbulence environment present in a steam generator.

Heretofore, POHC's have been destroyed by Thermal Incineration followed by a typical waste heat recovery system for steam generation. The problem is that incinerators cannot operate at flame temperature because of refractory limitations. A cooling media such as air, steam, or water is required to lower flue gas temperatures to maintain the refractory's structural integrity. This cooling media then adds mass to the flue gas and exits with the flue gas from the waste heat recovery at an elevated temperature. This causes a loss of sensible heat and in the case of water, a loss of latent heat in addition to a sensible heat loss.

SUMMARY OF THE INVENTION

It is therefore an object of this invention to provide a boiler fired or partially fired by combustible POHC's and thereby make efficient use of the combustion energy in the creation of steam and at the same time cause the DR&E of the POHC's to create an effluent within the guidelines set forth by various government regulations.

The objects of the invention are accomplished by method and apparatus which converts the POHC's into non-hazardous gas by burning the POHC's to create products of combustion which are then cooled by radiant heat exchange with a fluid, heat exchangeable tubing, to cool said products of combustion to a temperature corresponding to a practical residence time sufficient to convert said POHC's to non-hazardous effluent gas. The products of combustion are caused to be maintained at the said conversion or destruction temperature for a sufficient time such that substantially all of the POHC's are converted into the non-hazardous gas. Subsequent cooling of the products of combustion occurs by convection heat exchange between said products and a fluid filled tubing and subsequently exhausting resultant cool non-hazardous gaseous products of combustion.

DETAILED DESCRIPTION OF THE PREFERRED EMBODIMENT

Figure 1:
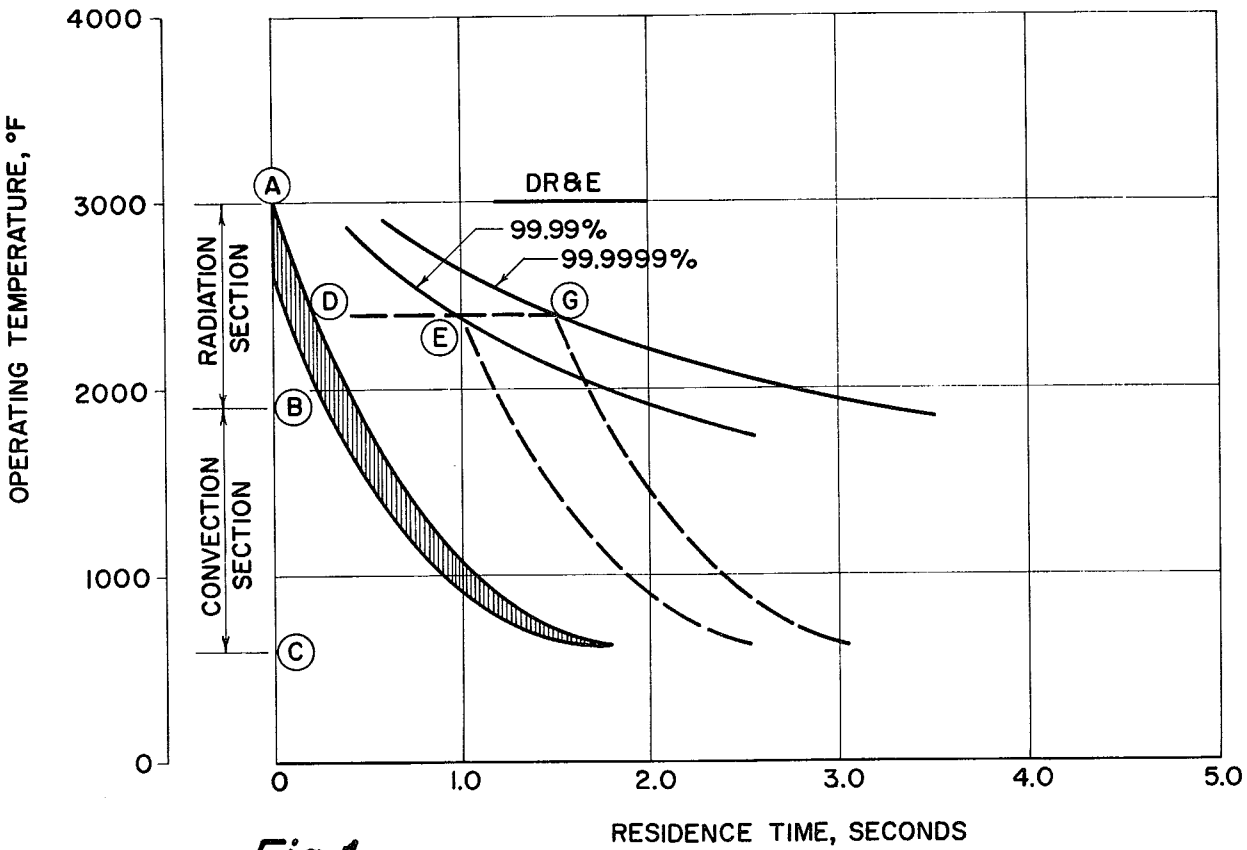
FIG. 1 is a graphic plot describing the operating time versus temperature preferred in the method and design of apparatus of this invention.

Before explaining the present invention, in detail, it is to be understood that the invention is not limited in its application to the details of construction and arrangement of parts illustrated in the accompanied drawings, since the invention is capable of other embodiment and being practiced or carried out in a variety of ways. Also, it is to be understood that the phraseology or terminology employed herein is for the purpose for description and not of limitation.

It is believed that the ability of a time-temperature environment to destroy a hazardous waste is predicted by the first order decomposition oxidation equation.

$$E = 100(1 - C/Co) = 100(1 - e^{-kt}) \quad (1)$$

Where

E=Destruction efficiency, %

C=Concentration at time t

Co=Initial Concentration k=Arrhenius Equation Reaction Rate, Sec. $^{-1}$ t=Time, second The Arrhenius equation for determination of the reaction rate is:

$$k = Ae^{-(E/RT)} \quad (2)$$

Where

A=Constant

E=Energy of Activation, BTU/lb-Mol

R=Universal gas constant, BTU/(lb-Mol (R°)

T=Temperature, R°

Taking the natural logarithm of equation (2) gives:

$$Ln\ k = A'(1/T) + B' \quad (3)$$

Where $A'$, $B'$=Constants

Equation (3) requires two performance points (k,1/T); to solve for the constants A' and B'. Test data from a commercial incinerator with a capacity of 100 MM BTU/hr has shown that K=5.75 sec.$^{-1}$ , for a temperature of 2100° F. and a residence time of 2.96 seconds. In addition, other combustion data has shown that a k=13.8 sec$^{-1}$ is achievable by a temperature of 2600° F. and residence time of 1.0 . Thus, two points for (k, 1/T), are:

| k, Sec.$^{-1}$ | T, R° | 1/T, 1/R° |
|---|---|---|
| 5.75 | 2560 | $3.906 \times 10^{-4}$ |
| 13.80 | 3060 | $3.268 \times 10^{-4}$ |

Solving equation; (3) by using these valves gives:

$$A' = 17.515 \times 10^{-4}$$

$$B' = 2.735$$

And equation (3) becomes:

$$Ln\ k = 17.515 \times 10^{-4}(1/T) - 2.735 \quad (4)$$

Thus, equation (1) and (4) allow determination of a locus of time temperature points in the combustion regime which will achieve a DR&E of 99.99% and 99.9999% with the latter being required for PCB(s) and the former being for other chlorinated compounds.

Other non-chlorinated hazardous wastes may require less residence time and temperature to achieve a DR&E of 99.99%

The solid lines plotted in FIG. 1 indicate the time temperature regimes required to achieve a 99.99% and 99.9999% DR&E. The upper curve is for a DR&E of 99.9999% and the lower of 99.99%. For example, the upper curve indicates that an operating temperature of 2600° F. and a residence time of 1.0 seconds is required to achieve a DR&E of 99.9999%.

Figure 2:
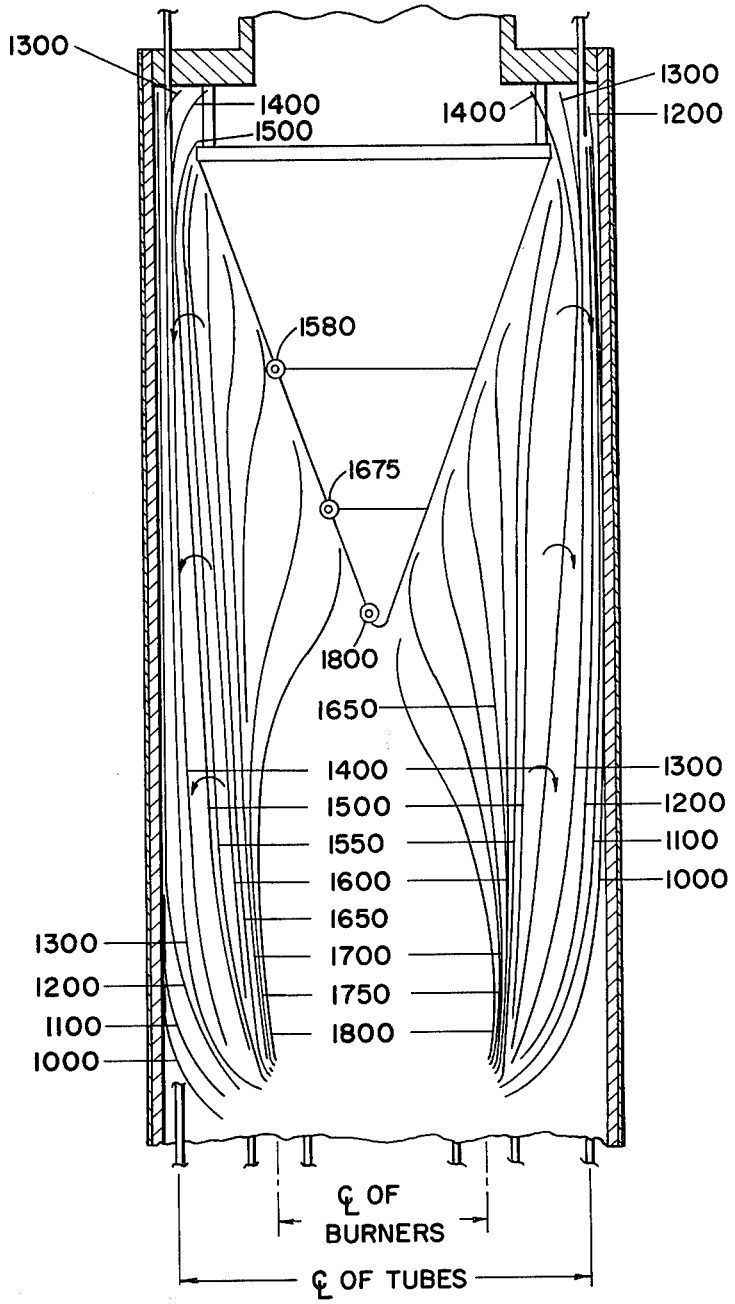
FIG. 2 is a schematic showing boiler isotherms as a means to understand the invention.

It is very difficult to predict the temperature residence time relationship in a boiler. FIG. 2 is an example of isotherms in a heater fitted with low intensity type burners which produce a long flame. The gas temperature is indicated to decrease from the center flame core to the 1,000° F. tube walls. A waste fired boiler having 600° F. tube walls would have a proportionally lower bulk gas temperature. The heater case suggests an average temperature in the neighborhood of 1600° F. At 1600° F, residence time of 3.0 sec. and 5.0 sec. is required to achieve a DR&E of 99.99 and 99.9999% respectively. A fired boiler would require a longer residence time which is, by the laws of nature, not available.

The boilers DR&E could be increased by the use of a high intensity burner (Combustion virtually complete in burner), but there are limitations imposed by allowable heat flux. Too high a heat flux would cause tube failure. Assuming that heat flux did not constrain operation, the temperature time profile is plotted in FIG. 1. The gas temperature at (A) is the fired combustible's Adiabatic flame temperature. This temperature decreases because of heat transfer to the radiant tubes and exits the radiation section at (B). The gases immediately enter the convection section in which its temperature continues to decrease because of heat transfer to the convection tubes and exits the convection section at (C). The temperature time regime required in the boiler is insufficient to achieve the required DR&E.

The required temperature time regime can be created by the addition of an essentially isothermal section between the radiant and convection sections of the boiler. This could be accomplished by a refractory lined section which is virtually adiabatic (minimum heat loss to the atmosphere).

The refractory lined section enables the device to produce a selected temperature time regime. For example, starting at (A) and cooling by radiation heat transfer to (D) then entering an adiabatic section till point (E) and then entering a Convecton Section and cooling to (C) would achieve a DR&E of 99.99%. A 99.9999% DR&E would be achieved when the adiabatic section was increased in size to provide the additional residence time from point (E) to point (C). Other temperature time regimes can be selected to achieve the required DR&E for any POHC.

Figure 3:
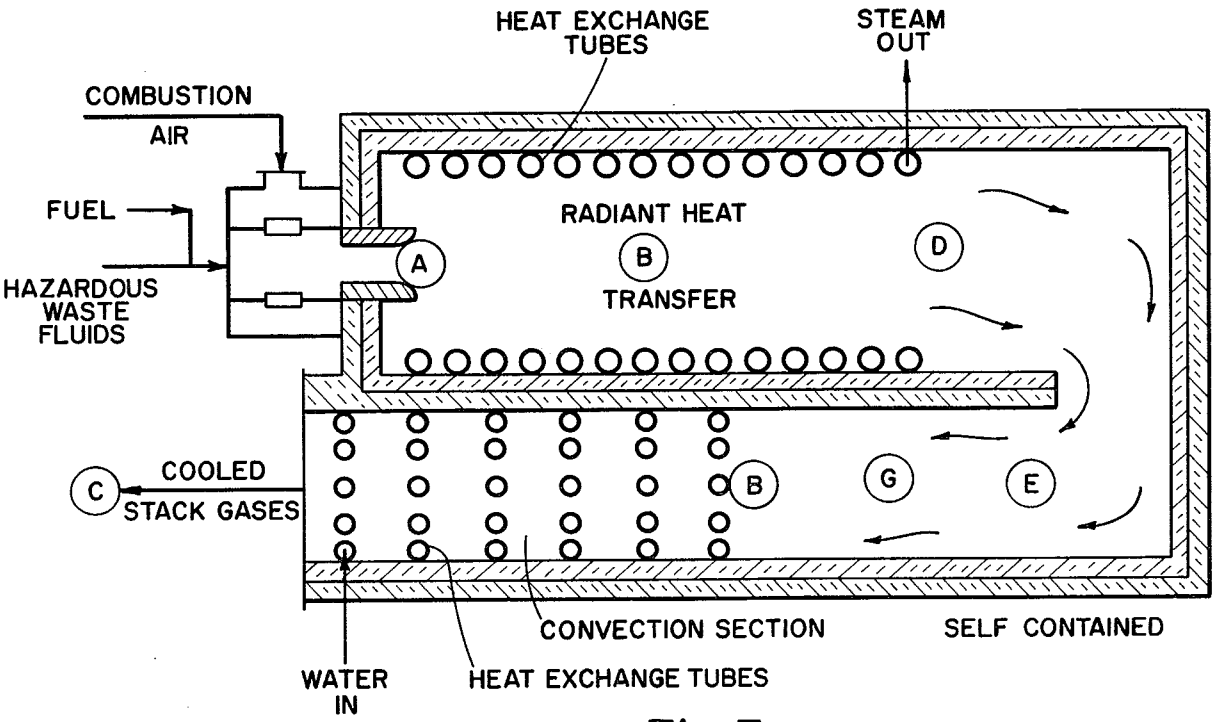
FIG. 3 is a schematic of an apparatus for use with the invention.

FIG. 3 is a schematic of a hazardous waste steam generator of this invention describing the various sections that would go to make up a boiler to operate in accordance with the invention to accomplish destruction of POHC's or converting POHC's to non-hazardous products of combustion. The alphabetic letters therein correspond to the plot of FIG. 1.

Although FIG. 3 is representative of one type of apparatus is to be understood that other forms of steam generators are inclusive of this invention provided the essentials of this invention are maintained. In this example, reversing the direction of flow of the gases 180°creates additional turbulence which further promotes the destruction of POHC's.

What is claimed is:

1. A method of converting fluids which are or contain principle organic hazardous constituents (POHC) into non hazardous constituents comprising the sequential steps of:

burning the POHC, first cooling products of combustion from said burning by heating a fluid in a heat exchange tubing by radiant heat from said burning to a given temperature for converting said POHC to non-hazardous constituents;

maintaining said given temperature for sufficient residence time such that substantially all of said POHC is converted; thence second cooling said products of combustion and converted POHC by convection heating a fluid in heat exchange tubing; and exhausting the resultant products of combustion.

2. The method of claim 1 wherein said POHC is a polychlorinated biphenol and wherein said burning creates a temperature in the range between 3000° and 3500° F, said first cooling reduces the temperature of said products of combustion to a range between 2300° and 1800° F. and said residence time is for about one to two seconds.

3. A method of converting fluids which are or contain principle organic hazardous constituents (POHC) comprising the sequential steps of:

burning the POHC, first cooling the products of combustion from said burning to a given temperature which converts said POHC to non hazardous constituents, maintaining substantially said given temperature for sufficient residence time for substantially all of said POHC is converted to non hazardous constituents, thence cooling said products of combustion and converted non hazardous constituents and exhausting same.

4. The method of claim 3 wherein said first and second cooling occurs by indirect heat exchange with water to produce useful steam.

5. The method of claim 3 wherein said conversion is at least 99.99% of the original POHC.

* * * * *